United States Patent [19]

Sorenson

[11] 4,383,154

[45] May 10, 1983

[54] POSITIVE ACTION ROCKER SWITCH

[75] Inventor: Richard W. Sorenson, Avon, Conn.

[73] Assignee: Carlingswitch, Inc., West Hartford, Conn.

[21] Appl. No.: 414,828

[22] Filed: Sep. 3, 1982

[51] Int. Cl.[3] ..... H01H 9/20

[52] U.S. Cl. ..... 200/291; 200/339; 200/323

[58] Field of Search ..... 200/291, 339, 65, 325, 200/323; 74/527

[56] References Cited

U.S. PATENT DOCUMENTS

| | | | |
|---|---|---|---|
| 3,588,409 | 6/1971 | Laitenen | 200/291 X |
| 4,016,378 | 4/1977 | Arthur | 200/291 X |
| 4,128,745 | 12/1978 | Marsilio et al. | 200/291 X |
| 4,314,121 | 2/1982 | Gaber | 200/339 X |
| 4,341,935 | 7/1982 | Josemans | 200/252 |

*Primary Examiner*—John W. Shepperd
*Assistant Examiner*—Renee Kidorf
*Attorney, Agent, or Firm*—McCormick, Paulding & Huber

[57] ABSTRACT

A plastic rocker is pivotally mounted in a plastic switch case and operates a conventional movable contact. The rocker has depending sides or legs which resiliently bend inwardly as a result of contacting abutments on the inside walls of the switch case providing a more positive action to hold the rocker and movable contact more securely in the various switch positions.

7 Claims, 4 Drawing Figures

POSITIVE ACTION ROCKER SWITCH

This invention relates generally to electric switches, and deals more particularly with a positive action rocker switch having complementary shaped surfaces on the rocker and the switch case to improve the stability characteristics of the switch positions.

In its presently preferred form the electric switch of the present invention includes a case having an upwardly open cavity defined by spaced integrally formed side walls, and these side walls define aligned openings for pivotally receiving projecting portions of the rocker or operating member. A movable contact element is adapted to selectively bridge certain fixed contacts in the bottom wall of the switch cavity, and the rocker member has a depending central portion which is connected to a detent or hole in the contact element so as to achieve movement of the latter in response to pivotal movement of the rocker. The rocker preferably has a cross sectional shape in the form of a U such that the web portion of the U is defined by the upper surface of the rocker. A depending central portion of the rocker is also integrally formed with the web portion of the U and is adapted to receive the means for connecting the pivotal rocker with the slidable contact element. The rocker is preferably hollow and defines depending leg portions as a result of its U-shape and these depending leg portions are resiliently deformable so that complementary shaped irregularities or nubs defined in part on the rocker leg portions and in part by the side walls of the case cooperate with one another to provide a positive action for the rocker as it moves toward either of its two limit positions. A second embodiment is disclosed where the same detent action is provided for a center position in a three position switch of the center off type.

DETAILED DESCRIPTION

Figure 1:
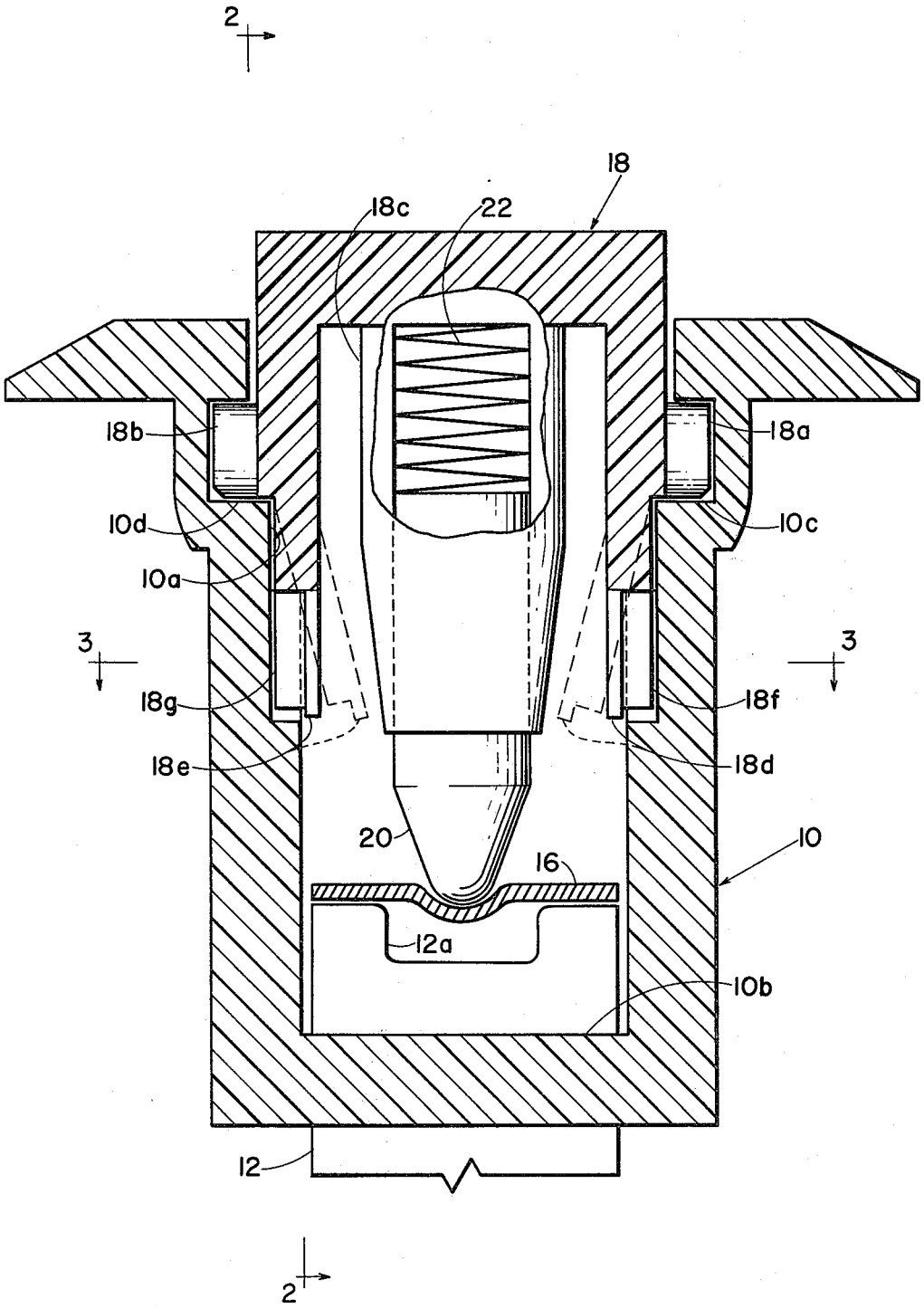
FIG. 1 is a sectional view taken through a laterally extending plane depicted at line 1—1 of FIG. 2.
Figure 2:
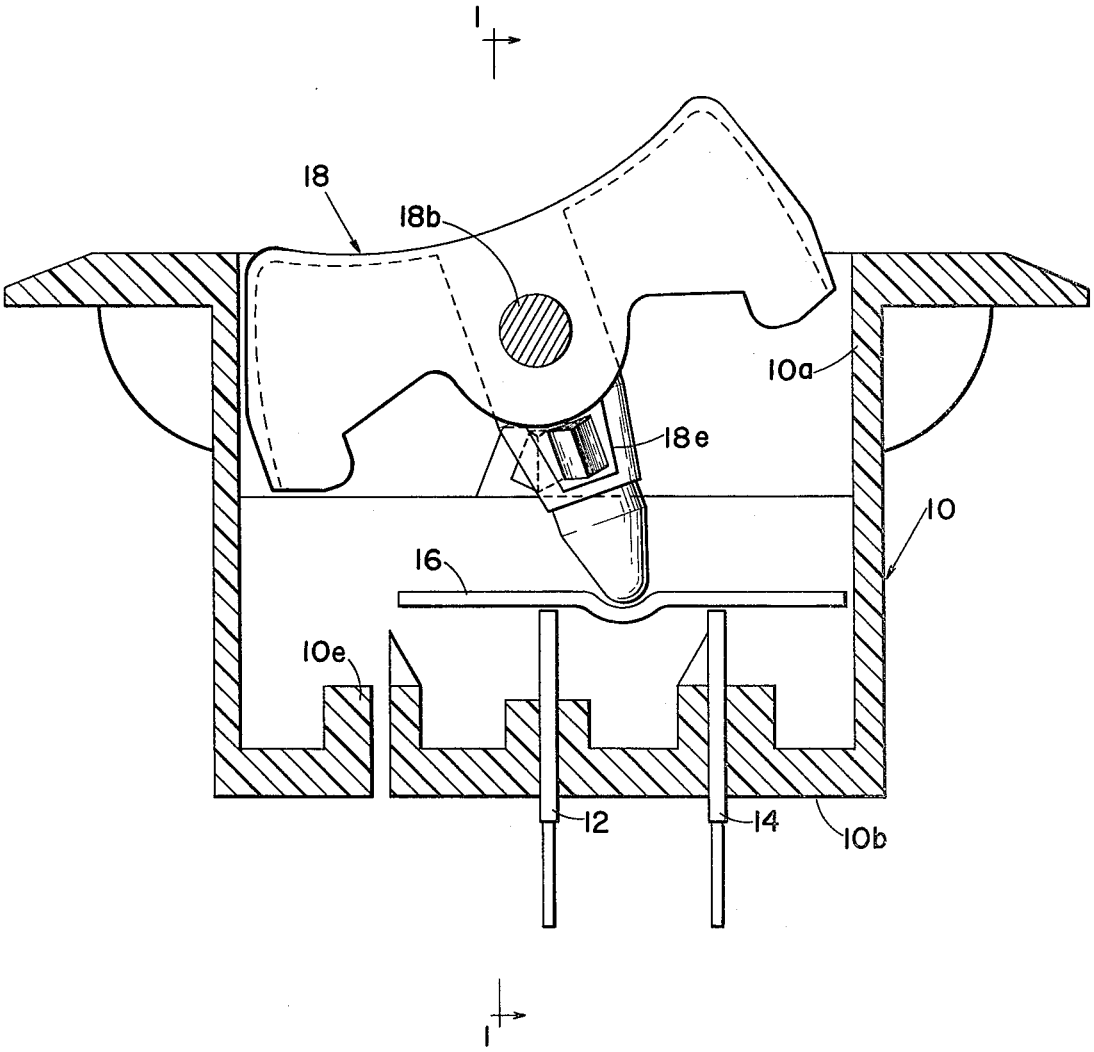
FIG. 2 is a sectional view taken generally on the line 2—2 of FIG. 1.
Figure 3:
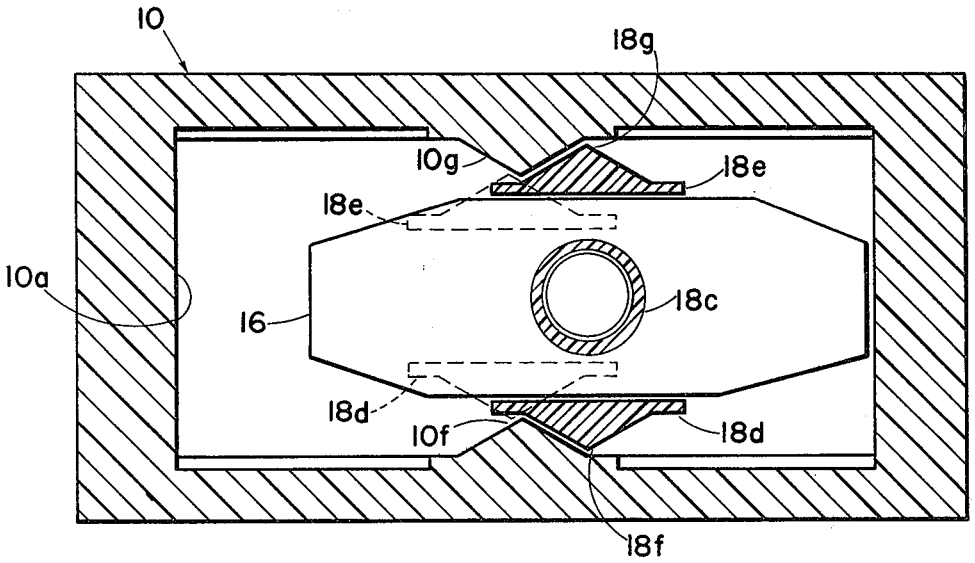
FIG. 3 is a horizontal sectional view taken generally on the line 3—3 of FIG. 1.

Turning now to the drawings in greater detail, a switch of the present invention is illustrated in FIGS. 1, 2 and 3 as comprising an upwardly open case 10 of dielectric plastic material defining an upwardly open cavity 10*a* having side and end walls defined by the case and integrally connected to a bottom wall 10*b* in which at least two fixed contact elements 12 and 14 are provided as best shown in FIG. 2. A movable contact element 16 is provided in the case cavity for bridging certain of the fixed contacts, again as best shown in FIG. 2, and an operating member or rocker 18 is pivotally mounted in the case to achieve sliding movement of the contact element 16 as a result of means 20/22 provided between the rocker 18 and the movable contact 16 as best shown in FIG. 1.

The case 10 defines aligned openings 10*c* and 10*d* which serve to pivotally support laterally projecting portions 18*a* and 18*b* of the rocker 18 and the rocker 18 defines a depending central portion 18*c* which is hollow and slidably receives a spring biased plunger element 20. The plunger element 20 together with the coiled compression spring 22 serve as the means for connecting the rocker 18 to the movable contact element 16. Element 16 preferably defines a recess for receiving the lower tip portion of the plunger 20 and the central fixed contact 12 is so shaped as to permit the sliding contact 16, and more particularly the depressed center portion thereof, to pass through an opening 12*a* defined for this purpose in the fixed contact 12 as best shown in FIG. 1.

As described above the rocker switch is of conventional configuration and the present invention provides for a more positive action for the rocker as it is pivotally moved from the position shown for it in FIG. 2 to an opposite position which corresponds closely to a mirror image of the FIG. 2 position. As shown, the FIG. 2 rocker switch is of the on/off variety (that is having two positions, the on position being illustrated, wherein contacts 12 and 14 are electrically connected by movable contact 16, and an off position [not shown] where movable contact 16 is moved out of engagement with fixed contact 14, such that raised plastic land 10*e* supports the end of contact 16 in much the same manner as upper end portion of fixed contact 14 supports the opposite end of element 16 in FIG. 2).

Turning now to a more detailed description of the interacting portions of rocker 18 and the side walls of case 10, which comprise the present invention, FIG. 1 illustrates the rocker element 18 with its depending leg portions 18*d* and 18*e* in normal positions in full lines and in deformed configuration in broken lines. FIG. 3 illustrates these same portions of the rocker 18, again in alternate positions, the full lines indicating a normal condition for these leg portions 18*d* and 18*e* and the broken line positions a deformed condition thereof.

The U-shaped cross section of the rocker 18 is best shown in FIG. 1 wherein the depending central portion 18*c* is illustrated as integrally connected to the web portion of the U, and wherein the depending leg portions 18*d* and 18*e* are illustrated as normally located in closely spaced relation to the case side walls, but as adapted to be deflected inwardly toward one another and away from these side walls in response to pivotal movement of the rocker 18 from the position shown in FIG. 2 through a central and unstable condition into the mirror image or off position described previously. The facing surface areas of these leg portions 18*d* and 18*e* and the adjacent areas of the side wall surfaces achieve this deformed condition for the rocker leg portions and these complementary areas are of irregular non-planar contour so as to cause the above-described deformation of the depending leg portions.

Figure 4:
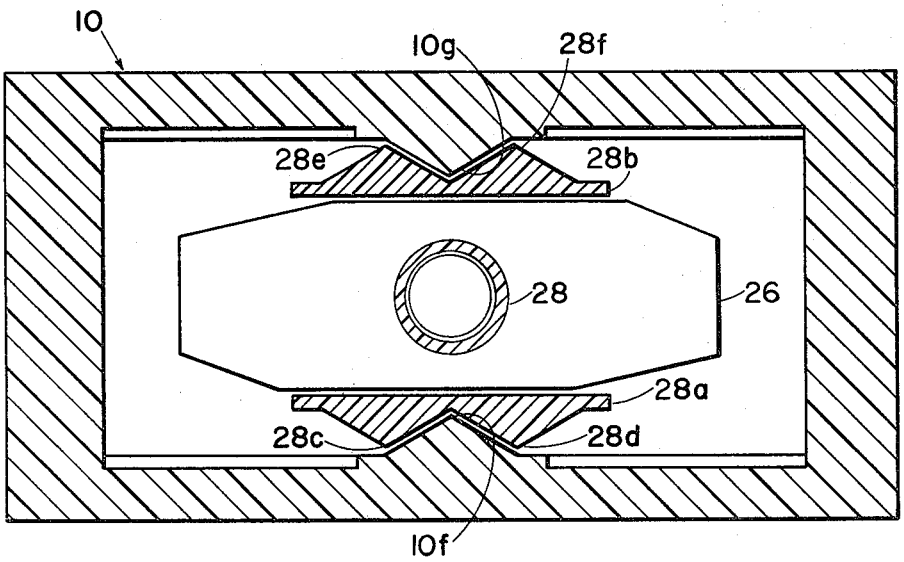
FIG. 4 is a view similar to FIG. 3 but illustrates a configuration for the rocker such that three switch positions are defined instead of two.

The resiliently deformable leg portions 18*d* and 18*e* of the U-shaped rocker 18 have laterally outwardly projecting nubs, 18*f* and 18*g* respectively, which cooperate with inwardly projecting complementary shaped nubs 10*f* and 10*g* respectively of the case side walls. These complementary nubs are arranged on the generally parallel and adjacent surface areas of the side walls of the case and the leg portions of the rocker. The rocker is itself fabricated from a single plastic material so that these leg portions are integrally formed and the rocker is molded so that these leg portions are designed to have a proper thickness so as to permit the desired degree of deformation to achieve the purposes and advantages of the present invention. Thus, the detent defining surface areas of the case side walls comprise symmetrically disposed nubs arranged on the vertical plane extending laterally through the center of the aligned switch case pivot openings. This is also true of the case 10 illustrated in FIG. 4 as shown at 10*g* and 10*f* in that view. The FIG. 4 rocker, however, has a pair of laterally outwardly projecting nubs 28*c*, 28*d* with reference to the leg 28*a*, 28*e*, and 28*f* with reference to the leg 28*b*. This configuration for the rocker 28 is so designed as to achieve a center off position for an electrical switch having three fixed contacts instead of two as illustrated for the switch of FIG. 2. The intermediate off position of the FIG. 4 switch is a stable one and the movable contact element 26 is generally similar to that described above with reference to the movable contact 16 in FIGS. 1, 2 and 3. However, movable contact element 26 illustrated in FIG. 4 is held in its centered position so that the movable element is in contact only with a center fixed contact such as that shown at 12 in FIG. 2. In the switch of FIG. 4 the other fixed contacts (not shown) are out of contact with this movable element 26.

Thus, the electrical switch of FIGS. 1–3 illustrates a two position rocker switch having on/off capability, and the rocker switch of FIG. 4 depicts a three position rocker switch having a center off position and two limit positions for energizing two different or independent electrical circuits.

I claim:

1. An electric switch comprising a case having an upwardly open cavity defined by spaced integrally formed side walls, fixed contacts in a bottom wall of said case, a movable contact element for selectively bridging said fixed contacts, an operating member having laterally projecting portions received in aligned openings, defined in the facing surfaces of said spaced side walls, said member having a depending central portion, means connecting said movable contact element to said depending central portion of said operating member to provide at least two switch positions, said operating member having a cross sectional shape of inverted U-shape, a web portion of said U-shape integrally formed with said depending central portion of said member, and said shape having integral depending leg portions located in closely spaced relation to said case side walls and having outside surface areas which are located adjacent to and move parallel to areas of said facing surfaces of said case side walls, said adjacent surface areas being of irregular non-planar contour to cause resilient deformation of said depending member leg portions as a result of pivotal movement of said member toward at least one of said at least two switch positions.

2. The switch of claim 1 wherein said operating member comprises a rocker with angularly related generally flat finger engageable lands defined in its exposed upper surface, and said projecting rocker portions which are pivotally received in said aligned side wall openings being defined by said leg portions between said web portion and said resiliently deformable contoured areas of said leg portions.

3. The switch of claim 2 wherein said irregular non-planar surface areas of said resiliently deformable leg portions more particularly comprise laterally outwardly projecting nubs, and detents defined by said generally parallel and adjacent surface areas of said facing side walls.

4. The switch of claim 3 wherein said switch case is fabricated from a dielectric plastic material, and said rocker also fabricated from a plastic material, said rocker being so molded as to have a hollow configuration below said lands and said leg portions defined by integrally depending sides of said rocker member.

5. The switch of claim 4 wherein said detent defining surface areas of said case side walls comprise inwardly projecting nubs symmetrically disposed with respect to one another and to a vertical plane extending laterally through said aligned switch case pivot openings.

6. The switch of claim 5 wherein said inwardly projecting nubs in said switch case side walls define two limit positions for said rocker.

7. The switch of claim 6 wherein said inwardly projecting nubs in said switch case side walls also define a center portion between said two limit positions.

* * * * *